US005431212A

United States Patent [19]

Arakawa et al.

[11] Patent Number: 5,431,212

[45] Date of Patent: Jul. 11, 1995

[54] METHOD OF AND APPARATUS FOR VACUUM CASTING

[75] Inventors: Yasuyuki Arakawa; Tamotsu Hasegawa, both of Nagoya; Atushi Ota, Toyota; Minoru Uozumi, Aichi, all of Japan

[73] Assignee: Toyota Jidosha Kabushiki Kaisha, Toyota, Japan

[21] Appl. No.: 267,901

[22] Filed: Jul. 6, 1994

[30] Foreign Application Priority Data

Jul. 20, 1993 [JP] Japan ..... 5-179345

[51] Int. Cl.[6] ..... B22D 18/04; B22D 18/06

[52] U.S. Cl. ..... 164/63; 164/119; 164/254; 164/306

[58] Field of Search ..... 164/63, 119, 120, 254, 164/306, 309

[56] References Cited

FOREIGN PATENT DOCUMENTS

| | | | |
|---|---|---|---|
| 2-155557 | 6/1990 | Japan . | |
| 3-31058 | 3/1991 | Japan . | |
| 3-68955 | 7/1991 | Japan . | |
| 3-198969 | 8/1991 | Japan . | |
| 4-158968 | 6/1992 | Japan . | |
| 4-274860 | 9/1992 | Japan . | |
| 5-123845 | 5/1993 | Japan . | |
| 5-146863 | 6/1993 | Japan . | |
| 5-146864 | 6/1993 | Japan . | |
| 5-146865 | 6/1993 | Japan . | |
| 5-169232 | 7/1993 | Japan . | |
| 5-63264 | 9/1993 | Japan . | |
| 1360887 | 12/1987 | U.S.S.R. | 164/119 |
| WO93/07977 | 4/1993 | WIPO | 164/63 |

*Primary Examiner*—J. Reed Batten, Jr.

*Attorney, Agent, or Firm*—Oblon, Spivak, McClelland, Maier & Neustadt

[57] ABSTRACT

In a method of vacuum casting wherein when the molten metal previously introduced into a molten metal reservoir is fed into a cavity, the lowest head of the molten metal in the molten metal reservoir is held to be higher than the level of a sprue, so that the cycle time of casting may be shortened and the quality of cast products may be improved. To this end, the interior of the molten metal reservoir is held gas tight while the sprue is opened by a gate member of straight tubular shape.

17 Claims, 10 Drawing Sheets

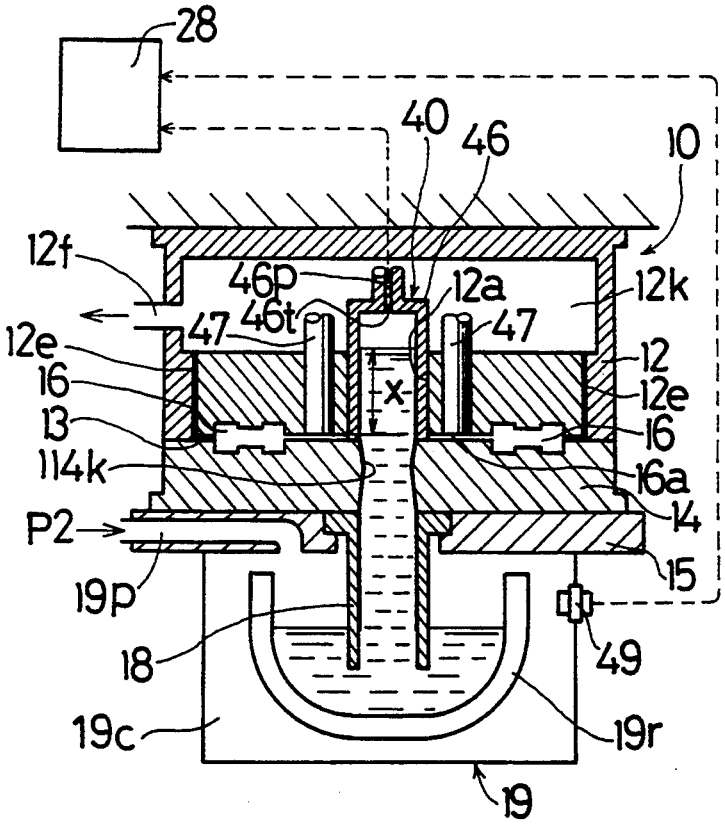
FIG. 8
FIG. 9(a)
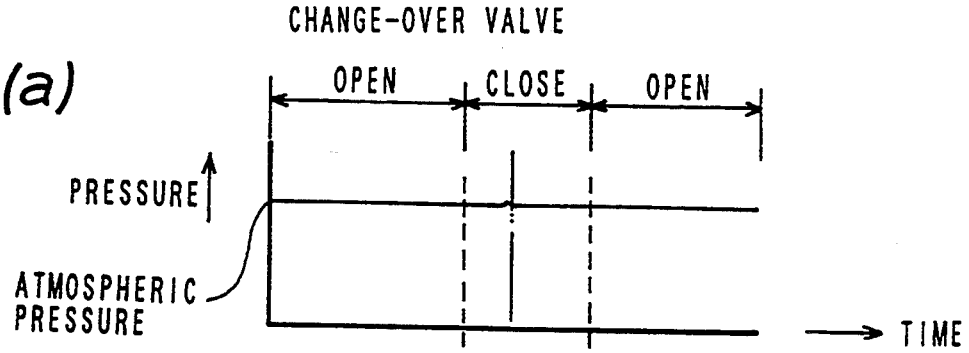
FIG. 9(b)
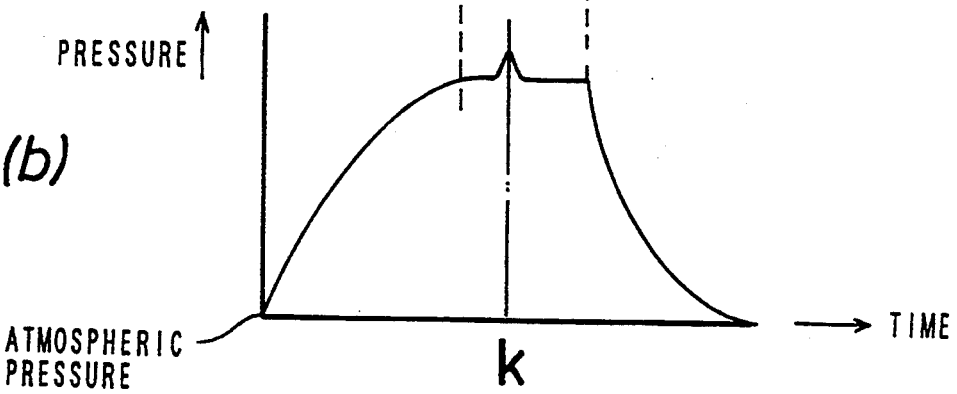

METHOD OF AND APPARATUS FOR VACUUM CASTING

BACKGROUND OF THE INVENTION

1. Field of the Invention

This invention relates to a method of and an apparatus for vacuum casting in which upon reaching of a predetermined pressure reduction degree of a cavity formed in a die, a sprue is opened by a gate member, causing the molten metal collected in a molten metal passage and a molten metal reservoir to flow into the cavity for casting.

2. Description of the Prior Art

FIG. 10 shows a related art apparatus which has been proposed by the applicant (Japanese Patent Application No. 4-309534). The Japanese application is not laid open on the priority date of the present application.

As shown in FIG. 10, in the related art vacuum casting process, when a die 50 having been closed is set over a gas-tight furnace 59, the pressure in the gas-tight furnace 59 is increased by a pressurizing means (not shown), so that the molten metal stored in a molten metal storage tank 59*r* is pushed up to the interior of a molten metal reservoir 52 through a molten metal passage 58. When a predetermined level is reached by the molten metal, the pressure in the gas-tight furnace 59 is held at a constant value. Further, substantially simultaneously with the pressure increase in the gas-tight furnace 59, the pressure in a cavity 56 is reduced by an evacuating pump (not shown). When a predetermined pressure reduction degree is reached in the cavity 56, a gate member 52*a* is raised to open a sprue 56*a*, thus causing the molten metal having been collected in the molten metal passage 58 and the molten metal reservoir 52 to flow into the cavity 56.

In the above vacuum casting process, however, the interior of the molten metal reservoir 52 is open to atmosphere. Therefore, the head in the molten metal reservoir 52 is greatly reduced during the flow of the molten metal into the cavity 56. This is caused by a pressure loss due to movement of the molten metal while the differential pressure between the pressure in the gas-tight furnace 59 and the pressure in the molten metal reservoir 52 is constant. In order to prevent air in the molten metal reservoir 52 from being withdrawn into the cavity 56, it is necessary to set the head in the molten metal reservoir 52 to a somewhat high level. That is, it is necessary to collect a great quantity of molten metal in the molten metal reservoir 52. Doing so poses the problems of elongation of the cycle time of the casting and great reduction of the molten metal temperature before the casting. Further, the molten metal reservoir 52 should have a large height, thus posing a problem of size increase of the casting apparatus.

A technique in which molten metal to be introduced into the cavity is led to a molten metal reservoir in advance, is disclosed in Japanese Laid-Open Patent Publication No. 3-198969. This technique is illustrated in FIG. 11. In this instance, a sprue 103*a* of a cavity 103 is opened and closed by a gate member 109. A molten metal passage 113 is communicated with a molten metal storage tank 107. The cavity 103 and the molten metal passage 113 are communicated with each other via the gate member 109 and a molten metal reservoir 119. The molten metal reservoir 119 has an upwardly extending branch 115, the top of which is communicated with pressure reducing means 117.

In this system, with the sprue 103*a* closed by the gate member 109, the pressure in the molten metal reservoir 119 and the branch 115 is reduced by the pressure reducing means 117 to lead the molten metal in the molten metal storage tank 107 through the molten metal-passage 113 to the molten metal reservoir 119 and the branch 115. Simultaneously with the pressure reduction by the pressure reducing means 117, the pressure in the cavity 103 is reduced by a vacuum pump 105. When the pressure in the cavity 103 is reduced to a predetermined pressure, the gate member 109 is pulled up to communicate the cavity 103 with the molten metal reservoir 119 and the branch 115, so that the molten metal having been led to the molten metal reservoir 119 and the branch 115 is led into the cavity 103.

In this case, the pressure reduction in the molten metal reservoir 119 and the branch 115 is continued by the pressure reducing means 117 while the gate member 109 is pulled up. Thus, the molten metal head in the molten metal reservoir 115 is not greatly reduced while molten metal is introduced into the cavity 103. Thus, the problem noted above can be solved to a considerable extent. However, molten metal is introduced into the molten metal reservoir 119 and the branch 115 with its lowest head (in this case the head in the molten metal reservoir 119 and the head right underneath the gate member 109 being lower than the head in the branch 115) lower than the level of the sprue 103*a*. Therefore, gas and/or foreign particles floating on the low head surface are liable to be withdrawn into the cavity 103.

SUMMARY OF THE INVENTION

An object of the invention is to realize a method of and an apparatus for vacuum casting which can prevent gas and/or foreign particles from being introduced into the cavity when molten metal having been introduced into the molten metal reservoir is introduced into the cavity with the sprue thereof opened and communicated with the molten metal reservoir by moving the gate member which has been closing the sprue, thus preventing the deterioration of the cast product.

According to the invention, there is provided a method of vacuum casting which comprises:

- a first step of closing, with a gate member, a sprue of a cavity formed in a die;
- a second step of leading molten metal stored in a molten metal storage tank through a molten metal passage to a molten metal reservoir which is communicated with the sprue through the gate member and is also communicated with the molten metal storage tank via the molten metal passage, until the lowest head of the molten metal led into the molten metal reservoir becomes higher than the level of the sprue;
- a third step of reducing the pressure in the cavity, the third step being executed either before, simultaneously with or after the second step;
- a fourth step of communicating the sprue with the molten metal reservoir and also with the molten metal passage by moving the gate member when the pressure in the cavity has been reduced to a predetermined pressure; and
- a fifth step of having the interior of the molten metal reservoir isolated from atmosphere and held gas tight while the molten metal having been led into the molten metal reservoir is introduced into the cavity as a result of the communication brought about in the fourth step between the sprue and the molten metal reservoir, with the lowest head of molten metal in the reservoir being held to be higher than the level of the sprue during this time.

In this method of vacuum casting, the lowest head of the molten metal that is introduced into the molten metal reservoir is above the sprue level, and also during the introduction of molten metal into the cavity, the lowest molten metal head in the molten metal reservoir is held to be above the sprue level. Thus, it is possible to prevent gas and/or foreign particles floating on the molten metal surface in the molten metal reservoir from being introduced into the cavity. In addition, since the molten metal reservoir is held gas-tight, it is possible to suppress the lowering of the molten metal head, thus making it possible to have a small quantity of molten metal that is held in the molten metal reservoir.

According to the invention, there is also provided an apparatus for vacuum casting which comprises:

a die having an internal cavity;

a gate member for switching a sprue of the cavity between a closed state and an open state;

a molten metal storage tank for storing molten metal;

a molten metal passage communicated with the molten metal storage tank;

a molten metal reservoir communicated with the sprue via a gate member and also communicated with the molten metal passage;

a change-over valve operable to be switched between a state to hold the molten metal reservoir interior gas tight and a state not to hold the molten metal reservoir interior gas tight;

an evacuating pump for reducing the pressure in the cavity;

molten metal introducing means for introducing the molten metal in the molten metal storage tank through the molten metal passage into the molten metal reservoir with the sprue held closed by the gate member and the molten metal reservoir interior not held gas tight by the change-over valve, the molten metal being introduced until the lowest head of molten metal introduced into the molten metal reservoir becomes higher than the level of the sprue; and gate member drive means for switching the gate member to an open state after the pressure in the cavity has been reduced to a predetermined pressure by the vacuum pump, molten metal has been introduced by the molten metal introducing means into the molten metal reservoir, and the change-over valve has been switched to hold the molten metal reservoir interior gas tight.

With this apparatus for vacuum casting, gas and/or foreign particles floating on the molten metal surface in the molten metal reservoir can be trapped, and the molten metal in the molten metal reservoir can be introduced into the cavity in a state that the lowering of the molten metal head is suppressed. Thus, it is possible to obtain high quality cast product.

The present invention will be more fully understood from the following detailed description and appended claims when taken with the accompanying drawings.

BRIEF DESCRIPTION THE DRAWINGS

FIG. 1 is a sectional view showing a vacuum casting apparatus according to a first embodiment of the invention;

FIGS. 2(*a*) to 2(*c*) are sectional views illustrating the operating status of the vacuum casting apparatus according to the first embodiment of the invention;

FIG. 3 is a sectional view showing a vacuum casting apparatus according to a second embodiment of the invention;

FIGS. 4(*a*) to 4(*c*) are sectional views illustrating the operating status of the vacuum casting apparatus according to the second embodiment of the invention;

FIG. 5 is a sectional view showing a vacuum casting apparatus according to a third embodiment of the invention;

FIGS. 6(*a*) to 6(*c*) are sectional views illustrating the operating status of the vacuum casting apparatus according to the third embodiment of the invention;

FIG. 8 is a sectional view showing a vacuum casting apparatus according to a fourth embodiment of the invention;

Figure 10:
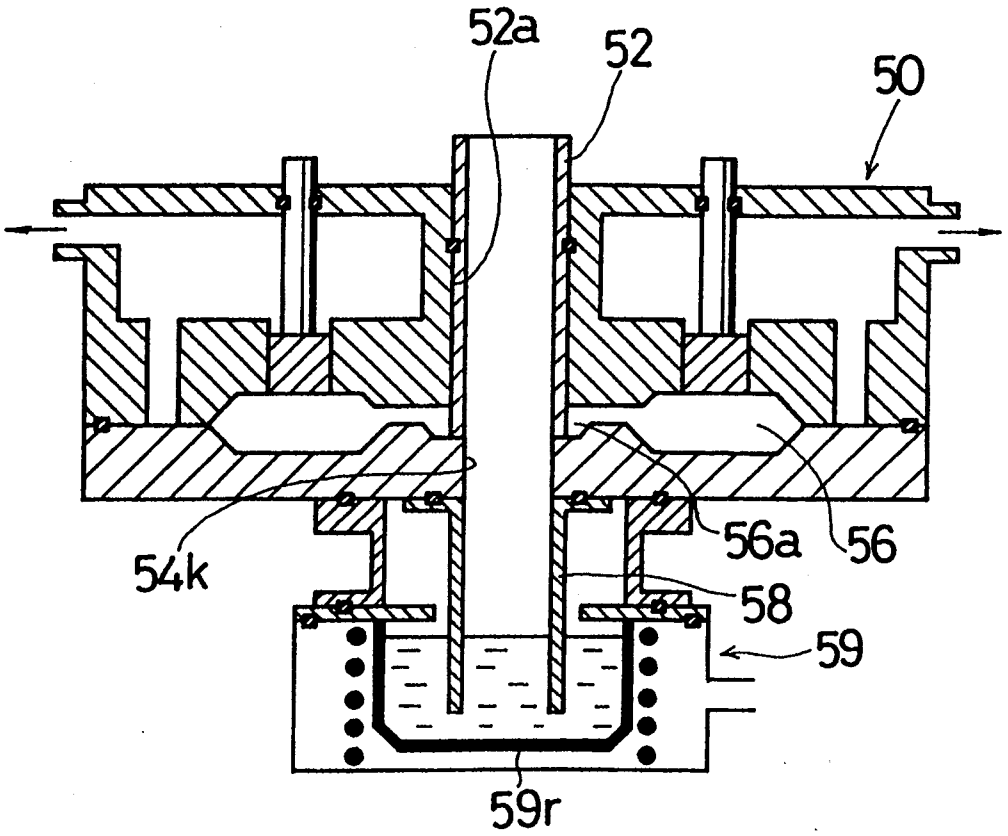
FIG.10 PRIOR ART
Figure 11:
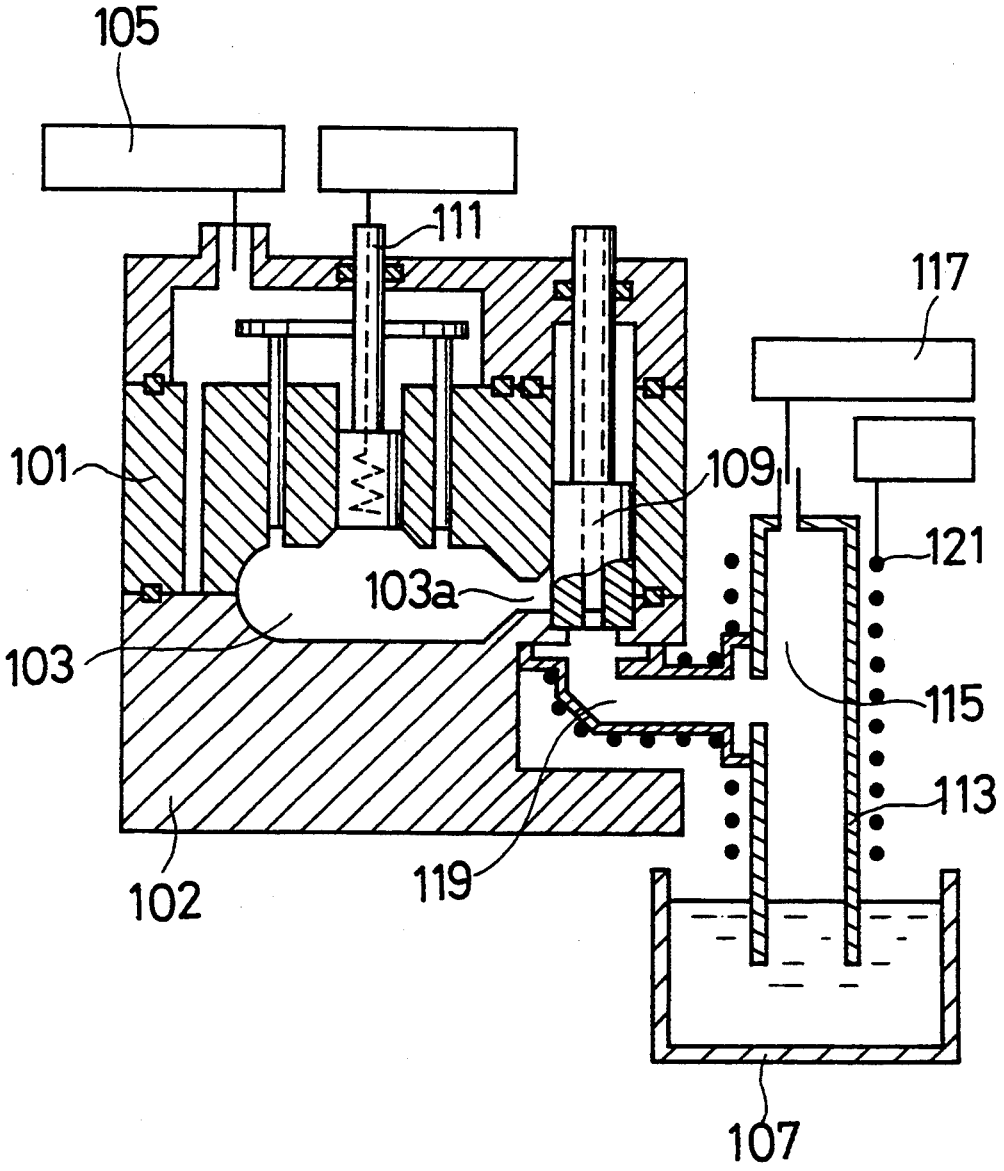
FIG.11 PRIOR ART

FIGS. 9(*a*) and 9(*b*) are graphs showing pressure changes in a gate chip and pressure changes in a gas-tight furnace;

FIG. 10 is a sectional view showing a prior art vacuum casting apparatus; and FIG. 11 is a sectional view showing a different prior art vacuum casting apparatus.

DETAILED DESCRIPTION OF THE PREFERRED EMBODIMENTS

A first embodiment of the invention will now be described with reference to FIGS. 1 and 2(*a*) to 2(*c*).

Figure 1:
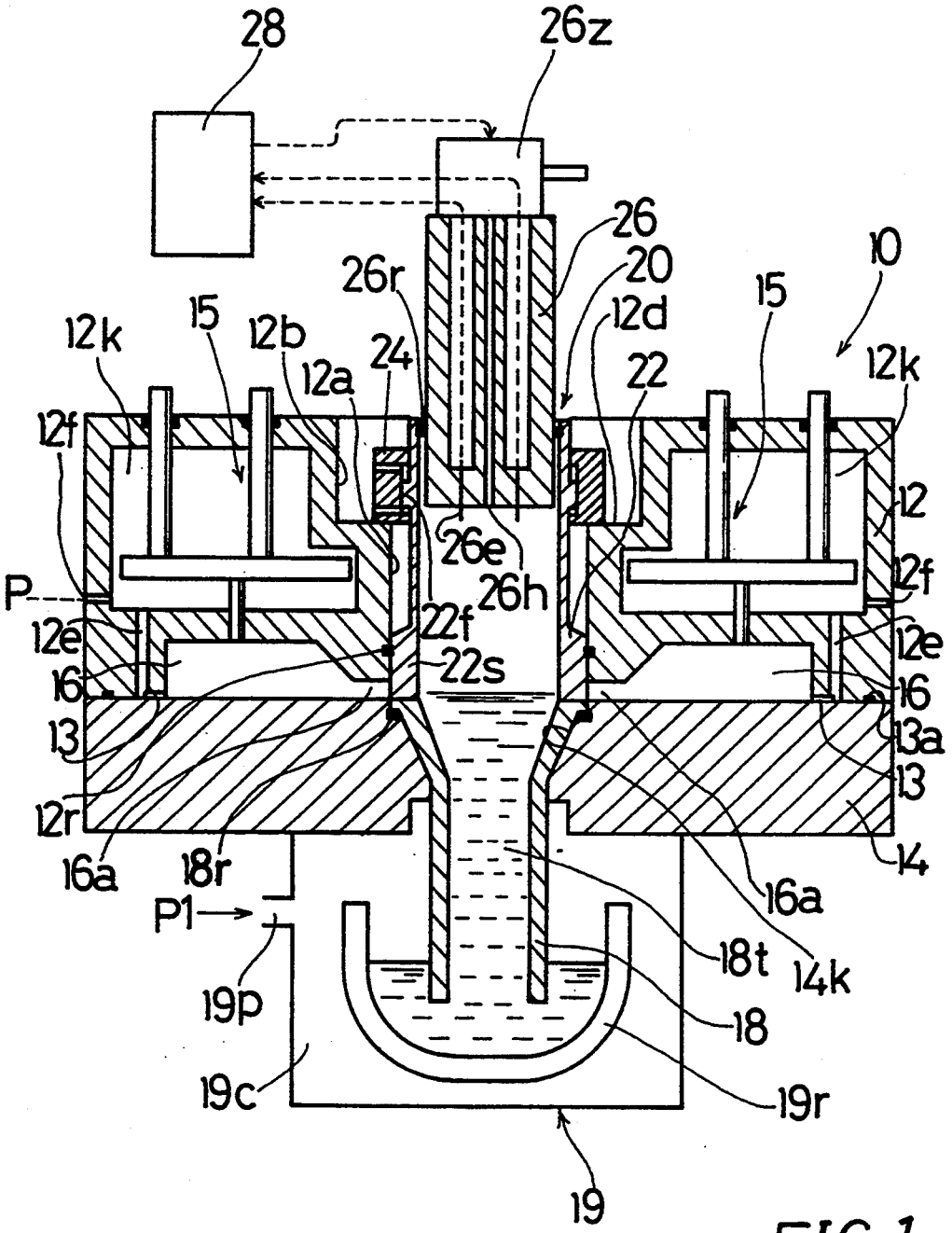

FIG. 1 is a sectional view showing a vacuum casting apparatus according to the first embodiment. This vacuum casting apparatus comprises a die 10 made of a metal. The die 10 comprises an upper die 12 and a lower die 14. With the upper and lower dies 12 and 14 closed together, a central cavity 16 is formed in the die 10. The cavity 16 has a central sprue 16*a* which is a molten metal supply port.

The lower die 14 has a central, upwardly flaring thorough hole 14*k*. A funnel-like stalk 18 is inserted downward through the thorough hole 14*k*, and it is set in the lower die 14 with its upper portion engaged with the flaring surface of the thorough hole 14*k*. An O-ring 18*r* is provided between the outer periphery of the stalk 18 adjacent the top thereof and the surface of the thorough hole 14*k*, thus securing the gas-tightness between the stalk 18 and the thorough hole 14*k*.

The upper die 12 has a centrally formed axial small diameter hole 12*a* and also a coaxial large diameter hole 12*b* formed over the small diameter hole 12*a* via a ring-like step 12*d*. The diameter of the small hole 12*a* is set to be equal to the diameter of the upper end of the thorough hole 14*k* in the lower die 14. In the closed state of the die, the small diameter hole 12*a* and the thorough hole 14*k* are held to be coaxial.

A gate mechanism 20 is accommodated in the holes 12*a* and 12*b* in the upper die 12. The gate mechanism 20 serves to open and close a molten metal passage 18*t* which extends through the stalk 18 to reach the cavity 16, and it includes a cylinder 24 for axially moving a gate member 22 and a cylindrical insertion member 26 to be inserted into the gate member 22.

The gate member 22 is a cylindrical member having an end portion (i.e., a lower portion in the drawings) having an increased thickness. As shown in FIG. 1, its end face engages with the entire upper end surface of the stalk 18 to isolate the molten metal passage 18*t* in the stalk 18 from the cavity 16. In this state, the inner space in the gate member 22 is communicated with the molten metal passage 18*t*, and molten metal that is led through the molten, metal passage 18*t* is collected in the gate member 22. The end portion 22*s* of the gate member 22 is set to be substantially equal to the diameter of the small diameter hole 12*a* in the upper die 12, and the gate member 22 can be moved vertically through the small diameter hole 12*a*.

An O-ring 12*r* is provided between the outer periphery of the end portion 22*s* and the surface of the small diameter hole 12*a* to secure the gas-tightness between the gate member 22 and the upper die 12.

The gate member 22 has a flange 22*f* formed on its outer periphery adjacent the upper end thereof. The flange 22*f* is accommodated in the cylinder 24 which is secured to the step 12*d* of the upper die 12, and can be moved axially like a piston through the cylinder 24. With this structure, when the cylinder 24 is operated, the gate member 22 is moved vertically through the small diameter hole 12*a* to open and close the molten metal passage 18*t* which extends through the stalk 18 to reach the cavity 16.

The gate member 22 corresponds to the gate member according to the invention, and the inner space in the gate member 22 corresponds to the molten metal reservoir according to the invention.

The cylindrical insertion member 26 is inserted in the inner space of the gate member 22, i.e., the molten metal reservoir. A seal member 26*r* is provided between the outer periphery of the insertion member 26 and the inner peripheral surface of the gate member 22. The insertion member 26 is coupled to a lift (not shown), and by operating the lift, it can be moved vertically through the gate member 22.

The insertion member 26 has an inner atmosphere communication hole 26*h* which is formed axially for purging air inside the gate member 22 to the outside. A change-over valve 26*z* is connected to the end (upper end) of the atmosphere communication hole 26*h*. When the change-over valve 26*z* is opened under control of a signal from a controller 28, the inside of the gate member 22 is communicated with the outside. When the change-over valve 26*z* is closed, the inside of the gate member 22 is held gas-tight.

A pair of electrodes 26*e* for molten metal detection are secured to the end of the insertion member 26 such that they project therefrom to a predetermined extent. Leads led out from the electrodes 26*e* are connected to a control circuit (not shown) in the controller 28. When the electrodes 26*e* are connected electrically by molten metal, the control circuit outputs a signal for stopping the lift noted above.

The cavity 16 formed by closing the upper and lower dies 12 and 14 is communicated via a gap 13 formed in the opposed surfaces of the upper and lower dies 12 and 14 to a pressure reduction passage 12*e* and an inner space 12*k* formed in the upper die 12. The inner space 12*k* is communicated via a pressure reduction port 12*f* and vacuum piping (not shown) to an evacuating pump P. To secure the gas tightness of the cavity 16, an O-ring 13*a* made of heat-resistant rubber is provided between edge portions of the opposed surfaces of the upper and lower dies 12 and 14.

With this structure, by operating the evacuating pump P with the sprue 16*a* of the cavity 16 closed by the gate member 22, the pressure in the cavity 16 is reduced to a rated pressure reduction degree.

In the inner space 12*k* of the upper die 12, a kick-out mechanism 15 is assembled to kick out a cast product form the upper die 12.

Underneath the die 10, a gas-tight furnace 19 is disposed for storing molten metal. The gas-tight furnace 19 includes a gas-tight vessel 19*c* and a molten metal storage tank 19*r* which is disposed in the gas-tight vessel 19*c* for storing molten metal. To the gas-tight vessel 19*c*, a piping 19*p* from a pressurizing unit P1 is connected. With the die 10 set in a predetermined state with respect to the gas-tight furnace 19, the end of the stalk 18 is dipped in the molten metal stored in the molten metal storage tank 19*r*.

In this state, high pressure gas is supplied from the pressurizing unit P1 through the piping 19*p* to the gas-tight furnace 19, so that the pressure of the supplied gas is applied to the molten metal in the molten metal storage tank 19*r*. Thus, the molten metal is partly pushed up from the molten metal storage tank 19*r* into the stalk 18 and the gate member 22. The pressure of the supplied gas is set according to the height to which the molten metal is pushed up.

The operation of this vacuum casting apparatus will now be described with reference to FIGS. 2(*a*) to 2(*c*).

First, the die 10 is closed and set on the gas-tight furnace 19. At this time, as shown in FIG. 2(*a*), the sprue 16*a* of the cavity 16 is closed by the gate member 22 of the gate mechanism 20. In addition, the change-over valve 26*z* of the insertion member 26 is opened, and the inside of the gate member 22 is open to atmosphere.

Then, the gas-tight furnace 19 is pressurized by the pressurizing unit P1, so that the molten metal stored in the molten metal storage tank 19*r* is pushed up through the stalk 18 into the gate member 22. When a predetermined level is reached by the molten metal, the pressure in the gas-tight furnace 19 is held constant. While the molten metal is led into the gate member 22, inner air is purged satisfactorily because the change-over valve 26*z* is open to atmosphere. The molten metal thus is supplied smoothly into the gate member 22.

Substantially simultaneously with the pressurization of the gas-tight furnace 19, the pressure in the cavity 16 is reduced by the vacuum pump P. During the pressure reduction in the cavity 16, a fine gap formed between the upper end face of the stalk 18 and the lower end face of the gate member 22 is sealed by molten metal because the stalk 18 and the gate member 22 are filled with molten metal. Thus, the pressure reduction degree in the cavity 16 can be improved.

Then, the lift is operated to lower the insertion member 26 through the gate member 22. When the two electrodes 26*e* secured to the end of the insertion member 26 are dipped in molten metal as shown in FIG. 2(*b*), they are electrically connected, and the controller 28 thus outputs a signal for stopping the lift. The insertion member 26 is thus held at its position with the electrodes 26*e* dipped in molten metal. In this state, the change-over valve 26*z* of the insertion member 26 is closed, so that the inside of the gate member 22 is held gas-tight with a minimum space. FIG. 2(*b*) shows a state right before the sprue 16*a* is opened by the gate member 22. At this time, the lowest molten metal head in the molten metal reservoir is above the level of the sprue 16*a*.

Figure 2A:
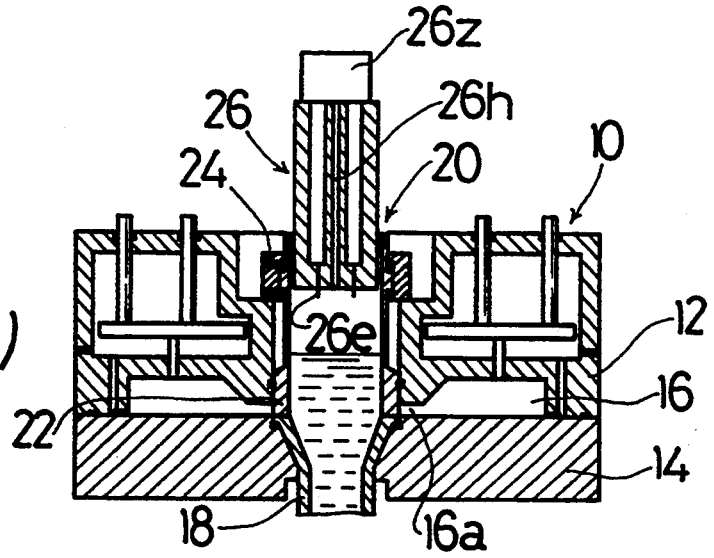
Figure 2B:
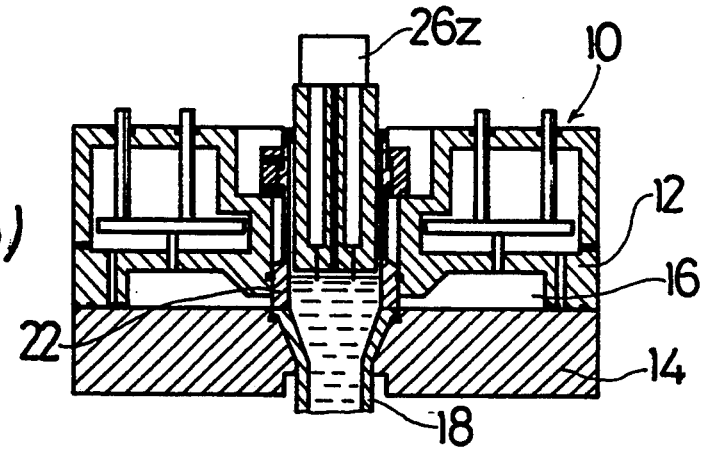
Figure 2C:
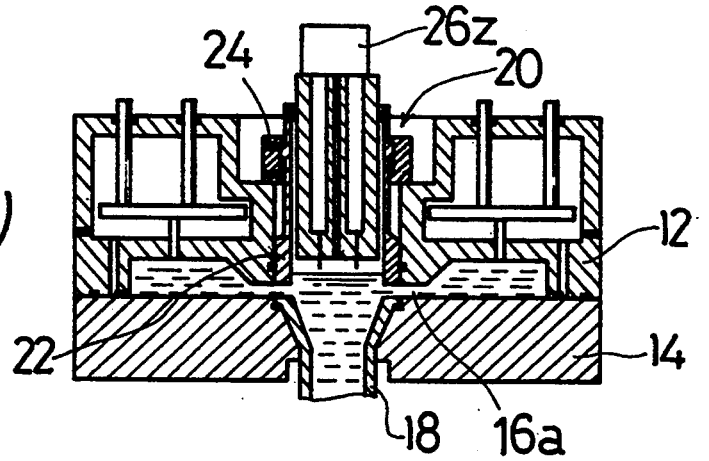

When a predetermined pressure reduction degree in the cavity 16 is reached in this way, the cylinder 24 is operated to raise the gate member 22 to open the sprue 16*a* of the cavity 16, as shown in FIG. 2(*c*). Thus, the molten metal that has been collected in the stalk 18 and gate member 22, is withdrawn and flows into the cavity 16. At this time, the molten metal head in the gate member 22 is going to be lowered to an extent corresponding to the pressure loss due to the flow of molten metal. However, the lowering of the head is suppressed because the inside of the gate member 22 is held gas tight and also because the inner space is held minimum. Thus, there is no possibility that air or the like in the gate member 22 is withdrawn into the cavity 16 even without setting the head in the gate member 22 to be high as in the prior art casting method.

When the cavity 16 is filled with molten metal in this way, the cylinder 24 is operated again to lower the gate member 22 to close the sprue 16*a* of the cavity 16 again. Then, the change-over valve 26*z* of the insertion member 26 is opened to open the inside of the gate member 22 to atmosphere, so that the molten metal that has been collected in the gate member 22 and the stalk 18 is returned to the molten metal storage tank 19*r*.

While this embodiment used the electrodes 26*e* for the molten metal head detection, it is also possible to adopt electromagnetic or electrostatic capacitance means for the detection.

Figure 3:
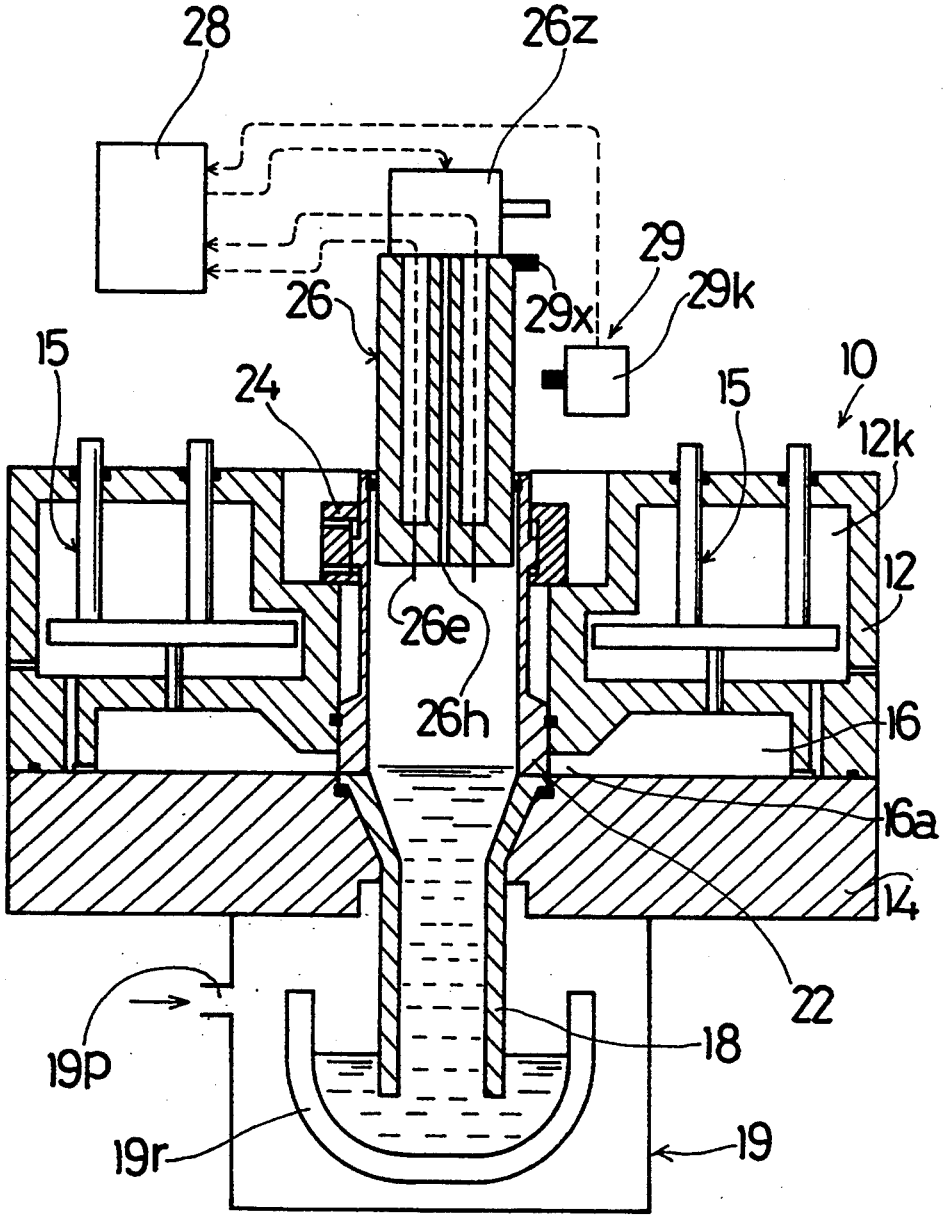

FIG. 3 is a sectional view showing a vacuum casting apparatus according to a second embodiment of the invention.

The vacuum casting apparatus of this embodiment includes a stroke setter 29 which is added to the vacuum casting apparatus of the first embodiment. Thus, the extent of insertion of the insertion member 26 into the gate member 22 can be set to be constant. The remainder of the structure is the same as in the vacuum casting apparatus of the first embodiment. Like parts are given like reference numbers and their description will not be repeated.

The stroke setter 29 includes an approach switch 29*k* provided on the upper die 12 at a regular position thereof and an operating projection 29*x* secured to the upper end of the insertion member 26. An operation signal from the approach switch 29*k* is input to a control circuit (not shown) in the controller 28.

The operation of the vacuum casting apparatus of this embodiment will now be described with reference to FIGS. 4(*a*) to 4(*c*).

First, the die 10 is closed and then set on the gas-tight furnace 19 in a predetermined manner. At this time, the sprue 16*a* of the cavity 16 is closed by the gate member 22 of the gate mechanism 20 as shown in FIG. 4(*a*). The change-over valve 26*z* of the insertion member 26 is opened, and the inside of the gate member 22 is communicated with the outside.

Then, the gas-tight furnace 19 is pressurized by the pressurizing unit, so that the molten metal stored in the molten metal storage tank 19*r* is pushed up through the stalk 18 into the gate member 22. When a predetermined level is reached by the molten metal, the pressure in the gas-tight furnace 19 is held constant. Substantially simultaneously with the pressurization of the gas-tight furnace 19, the pressure in the cavity 16 is reduced by the vacuum pump. During the pressure reduction in the cavity 16, a slight gap produced between the upper end face of the stalk 18 and the lower end face of the gate member 22 is sealed by molten metal because the stalk 18 and the gate member 22 are filled with molten metal. The pressure reduction degree in the cavity 16 is thus improved.

Then, the lift is operated to lower the insertion member 26 through the gate member 22 down to a position at which the operating projection 29*x* secured to the upper end of the insertion member 26 is lower in level than the approach switch 29*k*. The lift is stopped at a position at which the two electrodes 26*e* of the insertion member 26 are dipped in molten metal, as shown in FIG. 4(*b*). In this state, the change-over valve 26*z* of the insertion member 26 is closed to hold the inside of the gate member 22 gas tight.

Figure 4A:
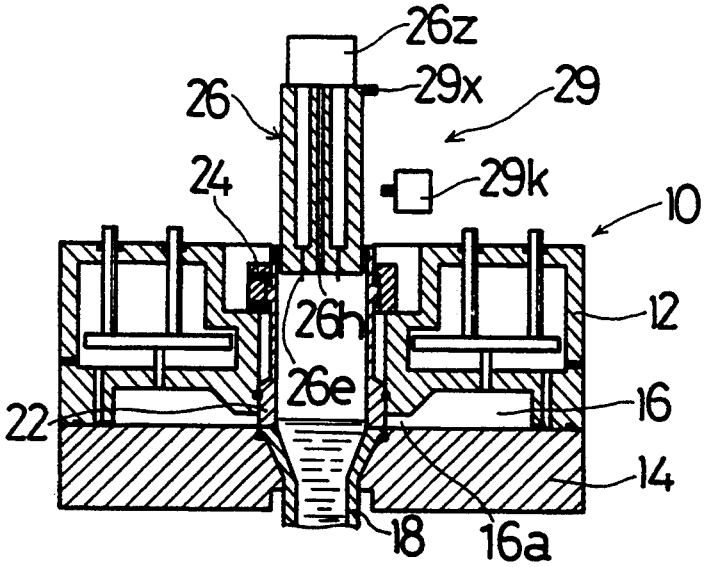
Figure 4B:
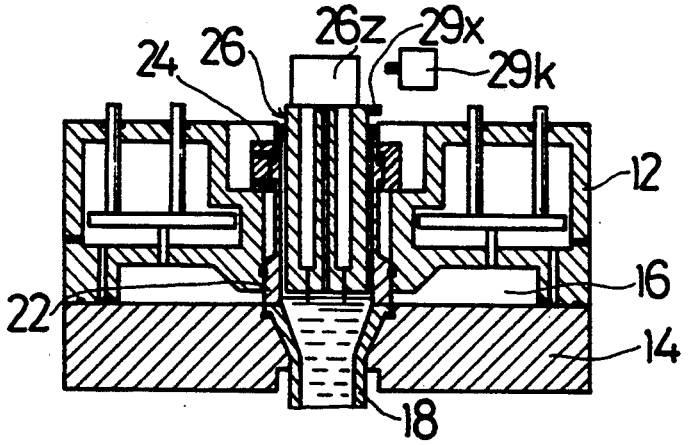
Figure 4C:
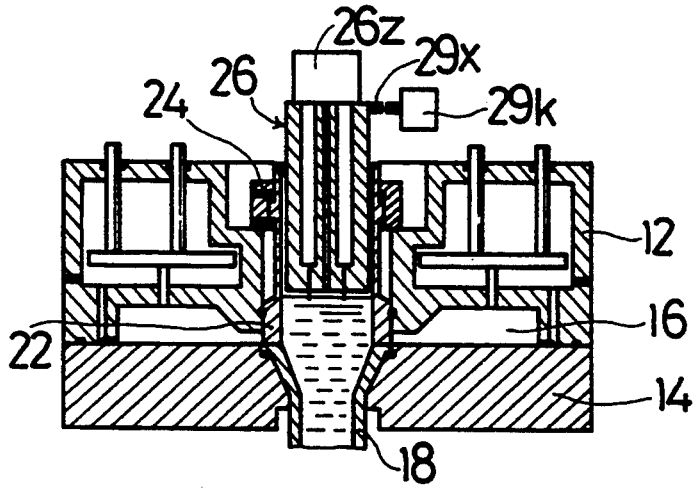

Then, the lift is operated again to raise the insertion member 26 up to a position at which the operating projection 29*x* and approach switch 29*k* are at the same level, as shown in FIG. 4(*c*). Since the change-over valve 26*z* of the insertion member 22 is closed, the head of molten metal is raised with the rising of the insertion member 26 to be held at a predetermined position. FIG. 4(*c*) shows the status before the sprue 16*a* is opened by the gate member 22. As shown, there is no head in the molten metal reservoir that is lower than the level of the sprue 16*a*. It is thus difficult for gas or the like floating on the head to be withdrawn through the sprue.

Then, the cylinder 24 of the gate mechanism 20 is operated to raise the gate member 22 and open the sprue 16*a* of the cavity 16. Thus, the molten metal that has been collected in the stalk 18 and the gate member 22 is caused to flow into the cavity 16.

As shown, with this embodiment, the same effects as in the vacuum casting apparatus of the first embodiment are obtainable. In addition, it is possible to set the molten metal head in the gate member 22 to a desired position. Further, there is no need of stringently accurately control the pressurization of the gas-tight furnace 19. While the stroke setter 29 of this embodiment uses the approach switch 29*k*, it is of course possible to adopt a method of measuring the position of the insertion member 26 as well.

Figure 5:
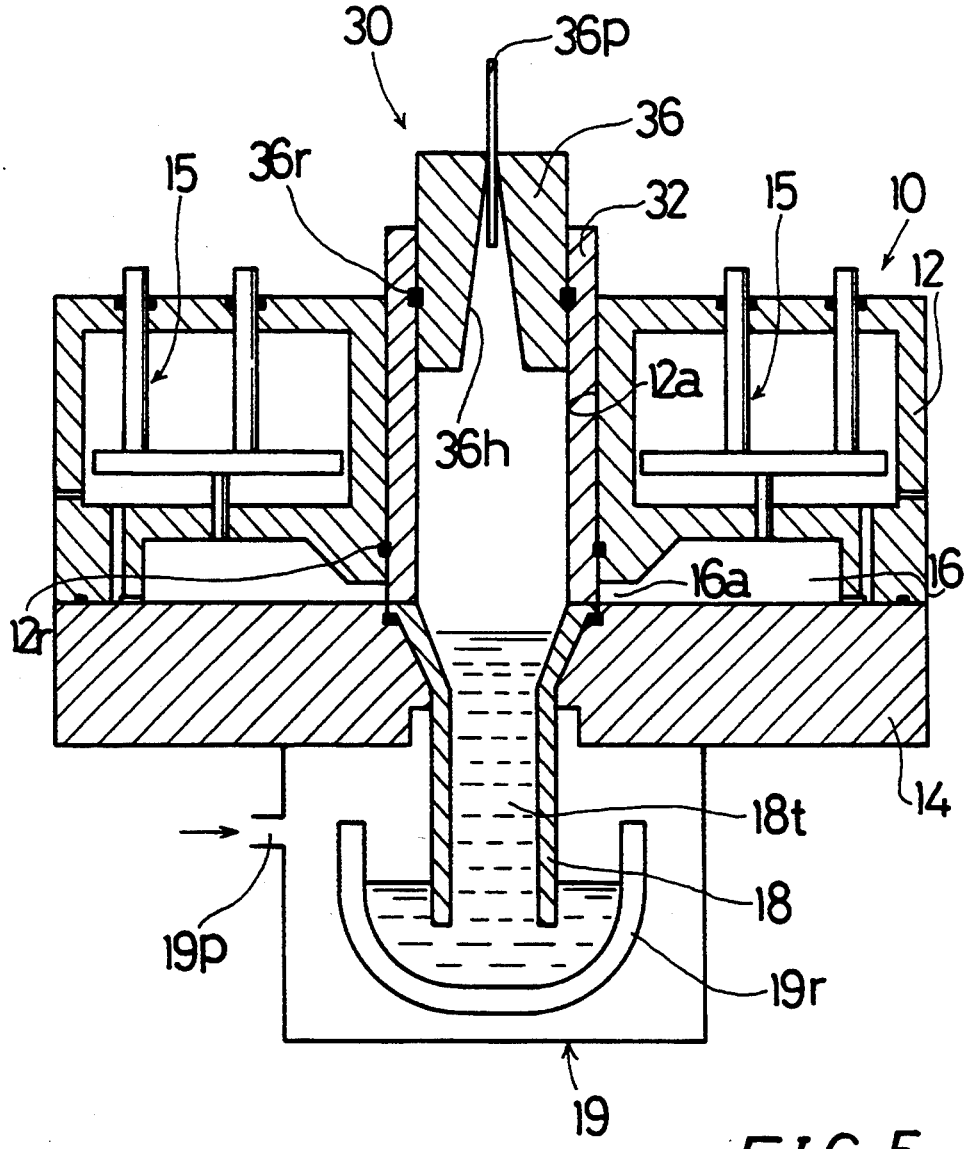
Figure 6A:
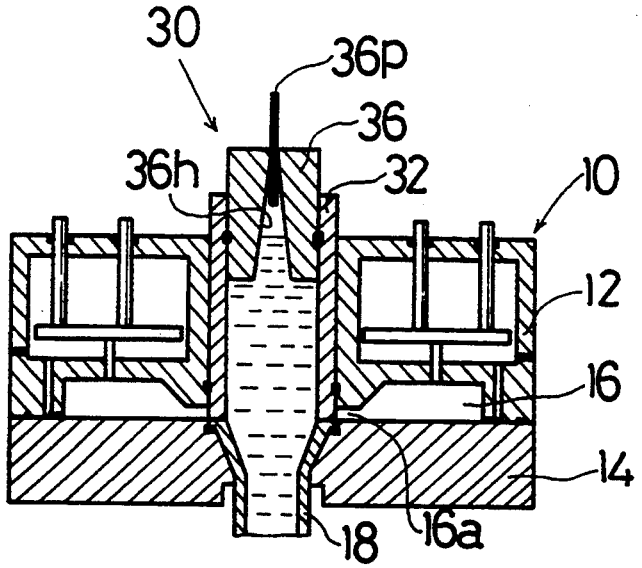
Figure 6B:
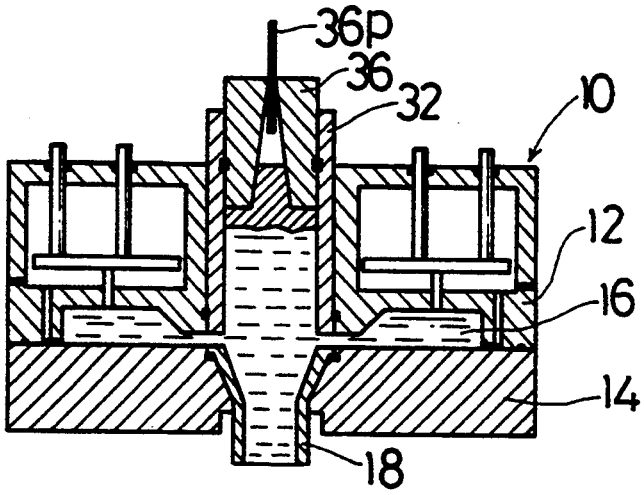
Figure 6C:
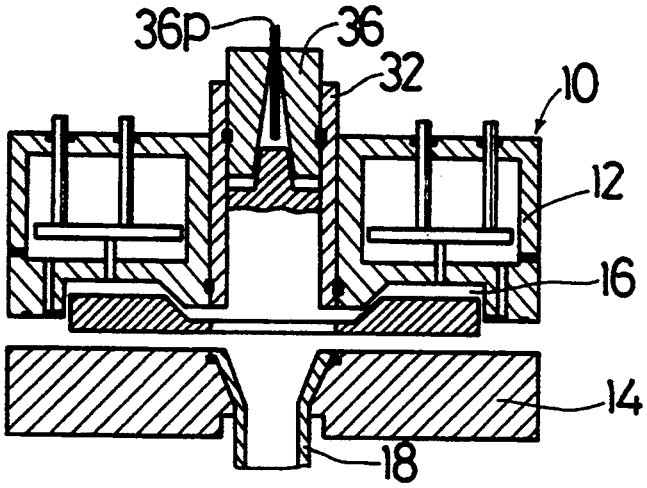

FIG. 5 is a sectional view showing a vacuum casting apparatus according to a third embodiment of the invention, and FIGS. 6(*a*) to 6(*c*) are sectional views illustrating the operating status of the same vacuum casting apparatus.

The vacuum casting apparatus of this embodiment concerns an improvement in the gate mechanism of the vacuum casting apparatus of the preceding first and second embodiments. The gate mechanism 30 in the vacuum casting apparatus of this embodiment includes a cylindrical gate member 32, a cylinder (not shown) for causing axial movement of the gate member 32, and a cylindrical plug member 36 inserted in the gate member 32. Like parts are given like reference numbers and their description will not be repeated.

The gate member 32 is substantially the same in the outer diameter as the diameter of the hole 12*a* in the upper die 12, and it is vertically slidable through the hole 12*a*. As shown in FIG. 5, when the gate member 32 is at its lower set position with its lower end in contact with the entire upper end face of the stalk 18, the molten metal passage 18*t* in the stalk 18 is isolated from the cavity 16. An O-ring 12*r* is provided between the outer periphery of the gate member 32 and the surface of the hole 12*a*, thus securing a seal between the gate member 32 and the upper die 12.

The cylindrical plug member 36 that is inserted in the gate member 32 has a central conical recess 36*h* open at the bottom. Further, it has an atmosphere communication hole (not shown) which extends from the apex of the cone, i.e., the center of the recess 36*h* and communicating with the outside. A push pin 36*p* is inserted in the atmosphere communication hole. The plug member 36 is mounted in a securing member (not shown) and is positioned to be at a predetermined level. Thus, with vertical movement of the gate member 32 through the hole 12*a* in the upper die 12, the plug member 36 is moved vertically with respect to the gate member 32. A seal member 36*r* is provided between the outer periphery of the plug member 36 and the inner periphery of the gate member 32 to secure seal between the two parts 36 and 32.

The operation of the vacuum casting apparatus of this embodiment will now be described with reference to FIGS. 6(*a*) to 6(*c*).

First, the die 10 is closed and set on the gas-tight furnace 19 in a predetermined way. At this time, the sprue 16*a* of the cavity 16 is closed by the gate member 32 of the gate mechanism 30. Further, the interior of the gate member 32 is open to atmosphere through the atmosphere communication hole formed in the plug member 36.

Then, the gas-tight furnace 19 is pressurized by the pressurizing means, so that the molten metal stored in the molten metal storage tank 19*r* is pushed up through the stalk 18 into the gate member 32 to reach the position of the recess 36*h* in the plug member 36 as shown in FIG. 6(*a*). In this state, the pressure in the gas-tight furnace 19 is held constant. Further, the molten metal in contact with the plug member 36 is cooled by this member.

Further, substantially simultaneously with the pressure reduction in the gas-tight furnace 19, the pressure in the cavity 16 is reduced by the evacuating pump. At this time, a slight gap produced between the upper end face of the stalk 18 and the lower end face of the gate member 32 is sealed by molten metal when the pressure in the cavity 16 is reduced because the stalk 18 and the gate member 32 have been filed with molten metal. The pressure reduction degree in the cavity 16 is thus improved.

After a predetermined pressure reduction degree in the cavity thus has been obtained, and with the atmosphere communication hole of the plug member 36 closed as a result of the solidification of the molten metal in the neighborhood of the plug member 36, as shown in FIG. 6(*b*), the gate member 32 is raised to open the sprue 16*a* of the cavity 16. Thus, the molten metal having been collected in the stalk 18 and the gate member 22 is caused to flow into the cavity 16.

While molten metal flows into the cavity 16 in this way, the interior of the gate member 32 is held gas tight by the solidified layer of molten metal, and thus the head is not substantially lowered. In addition, bubbles, impurities, etc. floating on the molten metal surface are solidified together with the molten metal and are not carried along with molten metal that flows into the cavity 16.

When the molten metal introduced into the cavity 16 is solidified, the die is opened as shown in FIG. 6(*c*), and the product is taken out. The solidified layer that remains in the gate member 32 is picked out to be removed by the kick-out pin 36*p*.

Figure 7:
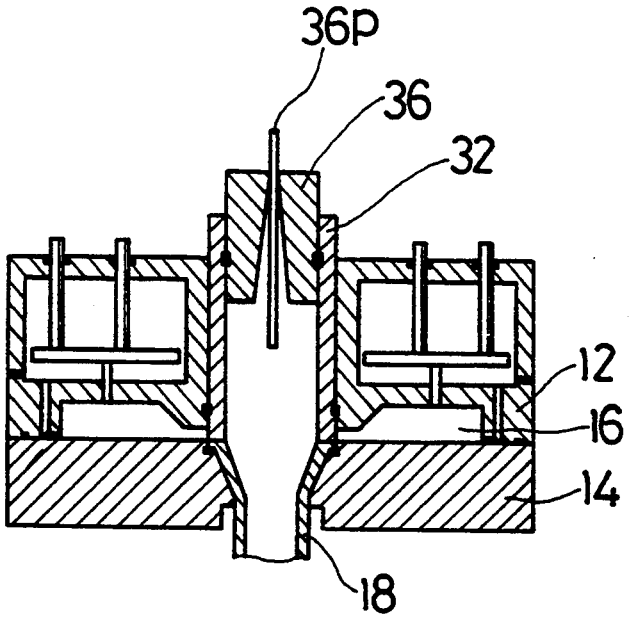
FIG. 7 is a sectional view illustrating the operating status of the vacuum casting apparatus according to a modification of the third embodiment.

In this embodiment, better effects are obtainable by providing the plug member 36 with forced cooling means. Further, as shown in FIG. 7, by setting the kick-out pin 36*p* such that it projects from the plug member 36, the solidified layer can be formed stably. Further, it is difficult for the solidified layer in the gate member 32 from being separated from the recess 36*h* in the plug member 36 when molten metal flows into the cavity 16.

FIG. 8 is a sectional view showing a vacuum casting apparatus according to a fourth embodiment of the invention.

In the vacuum casting apparatus of this embodiment, the inner pressure in the gas-tight furnace 19 is momentarily increased at the timing of in-flow of molten metal into the cavity 16, thus raising the head of molten metal in a gate chip 46 (corresponding to the gate member 22 in the preceding first to third embodiments) to suppress the lowering of the head. Like parts are given like reference numbers.

The vacuum casting apparatus of this embodiment has a die 10 comprising an upper die 12 and a lower die 14. With the upper and lower dies 12 and 14 closed, a central cavity 16 is formed in the die 10. The cavity 16 has a central sprue 16*a* as a molten metal supply port. The sprue 16*a* is opened and closed by a gate chip 46 and a shut pin 47 to be described later.

The lower die 14 has a central vertical molten metal passage 114*k*. With the lower die 14 set on a base 15, a stalk 18 which is set in the base 15 is connected to the lower end of the molten metal passage 114*k*.

The upper die 12, on the other hand, has a central vertical hole 12*a*. A gate chip 46 of a gate mechanism 40 is accommodated in the hole 12*a*. The gate chip 46 is a cylindrical member provided with a top lid. Its outer diameter is set to be substantially equal to the diameter of the hole 12*a* in the upper die 12, and its inner diameter is set to be substantially equal to the diameter of the molten metal passage 114*k* in the lower die 14. The gate chip 46 is coupled to a lift mechanism (not shown), and it can be moved vertically through the hole 12*a* with the operation of the lift mechanism. With the gate chip 46 in a lower set position, the end of the gate chip 46 is in contact with the surface of the lower die 14 such as to surround the molten metal passage 114*k*, thus isolating the molten metal passage 114*k* from the cavity 16.

The top lid portion of the gate chip 46 has an atmosphere communication passage 46*t*, and a change-over valve (not shown) is connected to the end of the atmosphere communication passage 46*t*. Thus, when the change-over valve is opened, the inside of the gate chip 46 is communicated with the outside. When the change-over valve is closed, on the other hand, the inside of the gate chip 46 is held gas tight. In the atmosphere communication passage 46*t*, a chip inner pressure sensor 46P is provided to detect the inner pressure in the gate chip 46. An output signal form the chip inner pressure sensor 46*a* is input to the control circuit in the controller 28.

The cavity 16 formed by closing the upper and lower dies 12 and 14, is communicated through a gap 13 formed between the opposed surfaces of the upper and lower dies 12 and 14 to a pressure reduction passage 12*e* and an inner space 12*k* formed in the upper die 12. The inner space 12*k* is communicated through a pressure reduction port 12*f* and a vacuum piping (not shown) to an evacuating pump (not shown).

With this structure, by operating the evacuating pump with the sprue 16a of the cavity 16 closed by the gate chip 46, the pressure in the cavity 16 is reduced to a rated pressure reduction degree.

Underneath the base 15 supporting the die 10, a gas-tight furnace 19 for storing molten metal is disposed.

The gas-tight furnace 19 includes a gas-tight vessel 19*c* and a molten metal storage tank 19*r* disposed in the gas-tight vessel 19*c* and for storing molten metal. To the gas-tight vessel 19*c*, a piping 19*p* from a pressurizing unit P2 is connected.

When the base 15 is set with respect to the gas-tight furnace 19, the gas-tight furnace 19 is held in a sealed state. In addition, the end of the stalk 18 is dipped in the molten metal in the molten metal storage tank 19*r*. Then, high pressure gas is supplied form the pressurizing unit P2 through the piping 19*p* to the gas-tight furnace 19, so that gas pressure is applied to the molten metal in the molten metal storage tank 19*r* to push up part of the molten metal from the molten metal storage tank 19*r* through the stalk 18 and the molten metal passage 114*k* into the gate chip 46. At this time, a furnace inner pressure sensor 49 which is provided in the gas-tight furnace 19 for detecting the furnace inner pressure, provides an output signal which is inputted to the control circuit of the controller 28.

The operation of the above vacuum casting apparatus will now be described.

First, the die 10 is closed and set together with the base 15 with respect to the gas-tight furnace 19. At this time, the sprue 16*a* of the cavity 16 is held closed by the gate chip 46. In addition, the change-over valve provided in the atmosphere communication passage 46*t* in the gate chip 46 is open, so that the inside of the gate chip 46 is communicated with the outside.

Then, the gas-tight furnace 19 is pressurized by the pressurizing unit P2, so that the molten metal stored in the molten metal storage tank 19*r* is pushed up through the stalk 18 into the gate chip 46. At this time, the head X of the molten metal in the gate chip 46 is set as X=(Casting volume)/(Sectional area of molten metal storage section of gate chip)+Y.

The value of Y is selected to be between a minimum level (50 mm) necessary for air in the gate chip 46 not to be carried along and a maximum level (150 mm) in a range in which the casting cycle is not extended and also the molten metal head is not greatly lowered.

Substantially simultaneously with the pressurization of the gas-tight furnace 19, the pressure in the cavity 16 is reduced by the evacuating pump. While the pressure in the cavity 16 is reduced, a slight gap produced between the surface of the lower die 14 and the end face of the gate chip 46 is sealed by molten metal because the stalk 18, the molten metal passage 114*k* and the gate chip 46 are filled with molten metal. The pressure reduction degree in the cavity 16 is thus improved.

Then, the change-over valve connected to the exhaust passage 46*t* of the gate chip 46 is closed to hold the interior of the gate chip 46 gas tight. In this state, the lift is operated to raise the gate chip 46 so as to open the sprue 16*a* of the cavity 16. Thus, the molten metal having been collected in the stalk 18 and the gate chip 46 flows into the cavity 16. At this time, in synchronism to the rising of the gate chip 46, the inner pressure in the gas-tight furnace 19 is increased momentarily as shown at point K in FIG. 9(*b*). Thus, the lowering of the molten metal head in the gate chip 19 is suppressed. No substantial pressure changes thus take place in the gate chip 46 while molten metal flows into the cavity 16, as shown in FIG. 9(*a*).

According to the invention, since the lowering of the molten metal head in the molten metal reservoir is suppressed while molten metal flows into the cavity, the amount of molten metal to be collected in the molten metal reservoir may be reduced compared to the prior art case. Thus, it is possible to reduce the casting cycle time and also suppress the molten metal temperature reduction before the casting. Further, there is no need of increasing the height of the gate member, thus permitting a compact structure of the vacuum casting apparatus.

In the above embodiments, molten metal was introduced into the molten metal reservoir by applying pressure to the molten metal surface in the molten metal storage tank. Instead, it is possible to reduce pressure in the molten metal reservoir to introduce molten metal thereinto. With this arrangement, it is possible to obtain satisfactory quality casting as in the above embodiments by holding the molten metal reservoir gas tight while molten metal in the molten metal reservoir is introduced into the cavity by opening the gate member.

In the above embodiments, however, unlike the arrangement of FIG. 11, the molten metal reservoir has a simplified shape such that no molten metal head is formed at a level lower than the level of the sprue, so that it is possible to obtain satisfactory quality cast products stably.

While the invention has been described with reference to preferred embodiments thereof, it is to be understood that modifications or variations may be easily made without departing from the scope of the present invention which is defined by the appended claims.

What is claimed is:

1. A method of vacuum casting comprising:

a first step of closing, with a gate member, a sprue of a cavity formed in a die;

a second step of feeding molten metal stored in a molten metal storage tank through a molten metal passage to a molten metal reservoir which is communicated with the sprue through the gate member and is also communicated with the molten metal storage tank via the molten metal passage, until the lowest head of the molten metal fed into the molten metal reservoir becomes higher than the level of the sprue;

a third step of reducing the pressure in the cavity, the third step being executed either before, simultaneously with or after the second step;

a fourth step of communicating the sprue with the molten metal reservoir and also with the molten metal passage by moving the gate member when the pressure in the cavity has been reduced to a predetermined pressure; and a fifth step of having the interior of the molten metal reservoir isolated from the atmosphere and held gas tight while the molten metal having been fed into the molten metal reservoir is introduced into the cavity as a result of the communication brought about in the fourth step between the sprue and the molten metal reservoir, with the lowest head of molten metal in the reservoir being held to be higher than the level of the sprue during this time.

2. The method of vacuum casting according to claim 1 further comprising a step of lowering an insertion member which is slidable through the molten metal reservoir, which has an atmosphere communication hole and which forms the top wall of the molten metal reservoir, down to a level right above the head of the molten metal having been fed into the molten metal reservoir in the second step, and then closing the atmosphere communication hole, said further step being executed between the second and fourth steps.

3. The method of vacuum casting according to claim 1 further comprising a step of lowering an insertion member which is slidable through the molten metal reservoir, which has an atmosphere communication hole and which forms the top wall of the molten metal reservoir, down to a level right above the head of the molten metal having been fed into the molten metal reservoir in the second step, then closing the atmosphere communication hole and then raising the insertion member up to a predetermined level, said further step being executed between the second and fourth steps.

4. The method of vacuum casting according to claim 1 further comprising a step of solidifying the head of the molten metal having been fed into the molten metal reservoir in the second step, said further step being executed between the second and fourth steps.

5. The method of vacuum casting according to claim 4, wherein the solidifying step includes a step of lowering a plug member which is slidable through the molten metal reservoir and which forms the top wall of the molten metal reservoir until the plug member is brought into contact with the head of molten metal, thus cooling the head with the plug member.

6. The method of vacuum casting according to claim 1, wherein the second step includes:

a first sub-step of communicating the molten metal reservoir with the atmosphere; and a second sub-step of applying pressure to the head of molten metal in the molten metal storage tank.

7. The method of vacuum casting according to claim 6 further comprising a step of tentatively increasing the pressure applied to the head of molten metal in the molten metal storage tank, said further step being executed simultaneously with the fourth step.

8. The method of vacuum casting according to claim 1, wherein the second step includes a step of feeding molten metal in the molten metal storage tank into the molten metal reservoir by reducing the pressure in the molten metal reservoir.

9. The method of vacuum casting according to claim 1, wherein the molten metal is fed into the molten metal reservoir in the second step such that the head of molten metal in the molten metal reservoir satisfies the following relation:

Molten metal head = (Sprue level) + (Cavity volume)/(Sectional area of molten metal reservoir) + (50 to 150 mm).

10. An apparatus for vacuum casting comprising:

a die having an internal cavity;

a gate member for switching a sprue of the cavity between a closed state and an open state;

a molten metal storage tank for storing molten metal;

a molten metal passage communicated with the molten metal storage tank;

a molten metal reservoir communicated with the sprue via the gate member and also communicated with the molten metal passage;

a change-over valve operable to be switched between a state to hold the molten metal reservoir interior gas tight and a state not to hold the molten metal reservoir interior gas tight;

an evacuating pump for reducing the pressure in the cavity;

molten metal introducing means for introducing the molten metal in the molten metal storage tank through the molten metal passage into the molten metal reservoir with the sprue held closed by the gate member and the molten metal reservoir interior not held gas tight by the change-over valve, the molten metal being introduced until the lowest head of molten metal introduced into the molten metal reservoir becomes higher than the level of the sprue; and gate member drive means for switching the gate member to an open state after the pressure in the cavity has been reduced to a predetermined pressure by the evacuating pump, molten metal has been introduced by the molten metal introducing means into the molten metal reservoir, and the change-over valve has been switched to hold the molten metal reservoir interior gas tight.

11. The apparatus for vacuum casting according to claim 10, wherein the molten metal reservoir is formed by a cylindrical member having a uniform sectional area, the cylindrical member also serving as the gate member.

12. The apparatus for vacuum casting according to claim 11 further comprising an insertion member slidable through the cylindrical member, having an atmosphere communication hole and forming the top wall of the molten metal reservoir, the insertion member being lowered down to a level right above the head of introduced molten metal after the introduction thereof by the molten metal introducing means, the atmosphere communication hole being closed after the reaching of that level by the insertion member.

13. The apparatus for vacuum casting according to claim 11 further comprising an insertion member slidable through the cylindrical member, having an atmosphere communication hole and forming the top wall of the molten metal reservoir, the insertion member being lowered down to a level right above the head of introduced molten metal after the introduction thereof by the molten metal introducing means, the atmosphere communication hole being closed after the reaching of that level by the insertion member, the insertion member being raised up to a predetermined level after the closing of the atmosphere communication hole.

14. The apparatus for vacuum casting according to claim 11 further comprising a plug member slidable through the cylindrical member, the plug member being lowered until it is in contact with introduced molten metal to cool the head thereof after the molten metal has been introduced into the molten metal reservoir by the molten metal introducing means.

15. The apparatus for vacuum casting according to claim 10 further comprising pressurizing means for applying pressure to the head of molten metal in the molten metal storage tank, the pressurizing means being driven while the change-over valve is not holding the molten metal reservoir gas tight.

16. The apparatus for vacuum casting according to claim 15 further comprising pressure increasing means for increasing the pressure applied to the head by the pressurizing means in synchronism with the driving timing of the gate member drive means.

17. The apparatus for vacuum casting according to claim 10, wherein:

the change-over valve is switched between a state of holding the molten metal reservoir interior isolated from the atmosphere and gas tight and a state of communicating the molten metal reservoir interior with the pressure reducing means; and the change-over valve holds the molten metal reservoir interior with the pressure reducing means while the sprue is held closed by the gate member and maintains this state until the molten metal having been introduced into the cavity is solidified.

* * * * *